US006880265B2

(12) United States Patent
Ladre et al.

(10) Patent No.: US 6,880,265 B2
(45) Date of Patent: Apr. 19, 2005

(54) METHOD OF DRYING METALLIC WASTE OF PYROPHORIC TENDENCIES THAT IS TO BE COMPACTED; APPARATUS AND COMPACTING CANISTER ASSOCIATED WITH SAID METHOD

(75) Inventors: Maurice Ladre, St. Denis les Bourg (FR); Serge Le Cocq, Montigny le Bretonneux (FR); Gérard Limeuil, Voisins le Bretonneux (FR)

(73) Assignee: Compagnie Generale des Matieres Nucleaires, Velizy-Villacoublay (FR)

( * ) Notice: Subject to any disclaimer, the term of this patent is extended or adjusted under 35 U.S.C. 154(b) by 0 days.

(21) Appl. No.: 10/613,353

(22) Filed: Jul. 3, 2003

(65) Prior Publication Data

US 2004/0006887 A1 Jan. 15, 2004

(30) Foreign Application Priority Data

Jul. 11, 2002 (FR) ..... 02 08725

(51) Int. Cl.[7] ..... F26B 3/00

(52) U.S. Cl. ..... 34/443; 34/507; 34/509; 34/516; 110/238

(58) Field of Search ..... 34/443, 507, 509, 34/516; 110/238, 248

(56) References Cited

U.S. PATENT DOCUMENTS

| | | | | |
|---|---|---|---|---|
| 4,401,463 A | | 8/1983 | Melin et al. | |
| 4,808,337 A | | 2/1989 | Ramm et al. | |
| 5,054,348 A | | 10/1991 | Anciaux et al. | |
| 5,248,453 A | | 9/1993 | Ramm | |
| 5,445,789 A | | 8/1995 | Wanetzky et al. | |
| 5,551,958 A | * | 9/1996 | Antal, Jr. | 44/629 |
| 5,592,027 A | | 1/1997 | Jacq et al. | |
| 6,048,419 A | | 4/2000 | Guerin et al. | |

FOREIGN PATENT DOCUMENTS

| | | |
|---|---|---|
| DE | 93 03 642.6 | 3/1993 |
| FR | 2 574 917 | 12/1984 |
| FR | 2 706 332 | 6/1994 |
| FR | 2 746 054 | 3/1996 |
| GB | 1 510 494 | 5/1978 |
| JP | 03-089200 | 4/1991 |
| JP | 11-337693 | 12/1999 |
| JP | 2002-156488 | 5/2002 |
| JP | 2003-215295 | 7/2003 |
| WO | WO 90/05984 | 5/1990 |
| WO | WO 94/15775 | 7/1994 |

OTHER PUBLICATIONS

French Patent Office Preliminary Search Report, in French, dated Mar. 28, 2003.

* cited by examiner

*Primary Examiner*—Jiping Lu
(74) *Attorney, Agent, or Firm*—Cohen, Pontani, Lieberman & Pavane

(57) ABSTRACT

The present invention provides:

a method of drying metallic waste having pyrophoric tendencies (liable to catch fire and/or explode), said waste being for compacting;

an apparatus for drying said waste, the apparatus including a compacting canister and being suitable for implementing said drying method; and a canister for compacting said waste, the canister being particularly adapted to implementing said drying method.

12 Claims, 2 Drawing Sheets

METHOD OF DRYING METALLIC WASTE OF PYROPHORIC TENDENCIES THAT IS TO BE COMPACTED; APPARATUS AND COMPACTING CANISTER ASSOCIATED WITH SAID METHOD

FIELD OF THE INVENTION

The present invention relates to a method of drying metallic waste having pyrophoric tendencies (liable to catch fire and/or explode), said waste being for compacting.

The invention also provides:

an apparatus for drying such waste, the apparatus including a canister for compacting said waste and being suitable for implementing said drying method; and a canister for compacting said waste, the canister being particularly adapted to implementing said drying method.

The present invention has been designed and developed in the nuclear context. It is described below more particularly with reference to this context, however the person skilled in the art will readily understand on reading the text below that the principle of the invention—drying material having pyrophoric tendencies in a compacting canister—is transferable to other fields.

BACKGROUND OF THE INVENTION

The shells and endpieces that result from shearing irradiated nuclear fuel assemblies (said shearing being described in particular in patent application EP-A-0 347 312) are conventionally received in a common drum specific to this type of highly active waste, at the outlet from their respective rinsing machines. They are then encapsulated (unchanged) in a slip of cement; said slip is cast into the drum containing the waste until the drum has been filled. After welding on a safety cover, drums filled in this way are transferred directly to a storage workshop.

In order to reduce significantly the volume of concrete-covered waste that needs to be stored, it has been recommended that the shells and endpieces should be compacted. A method of compacting is described in particular in patent application WO-A-94/16449. For safety reasons, the waste can be compacted only after it has been dried and saturated in inert gas (internal inerting). The waste is compacted in a compacting canister which is preferably likewise maintained in an inert atmosphere (external inerting, around the canister inside a compacting skirt), with optimum recovery of the gases that escape. Those internal and external inerting techniques are described by the Applicant in its applications WO-A-94/15775 and FR-A-2 746 054.

In this context, the Applicant is now dealing with the technical problem of drying waste prior to compacting it. As mentioned above, such prior drying is essential insofar as it is desired, during compacting, to avoid any spraying phenomenon and to limit the phenomenon of radiolysis during subsequent storage.

In said context, the Applicant has had to opt for a given drying technique performed on the waste, optionally packaged for compacting purposes.

Conventional drying techniques, in an oven or in a stream of gas are poorly adapted to the nature of the contaminated waste in question. The associated apparatus is open and does not contain means for making it easy to handle such waste which comes in pieces of relatively small size.

Given the nature of said waste, it has been decided to carry out drying in the compacting canister. This avoids handling the dry waste and volatization of dry dust having pyrophoric tendencies.

Radiation heating by means of resistance elements placed around said canister has been found to be of poor performance (the center of said canister was not heated fast enough) while heating in an oven presented the drawbacks mentioned above, so the Applicant has opted for passing a stream of hot inert gas through said waste packaged in its compacting canister; said canister has been adapted for this purpose.

Such a method of drying metallic waste that is liable to catch fire and/or explode, as described in detail below, provides good performance, is reliable, and can be implemented with total confinement.

The term "inert" is applied above to the gas as used for drying waste in accordance with the invention. Said term is repeated below in the present description and the accompanying claims, to describe said drying gas and also a sweeping gas that can be used in combination with said drying gas. This term "inert" means that the gas in question is inert with respect to the risk of catching fire and/or of explosion that exists in the present context. It does not restrict said gas to gases which are chemically inert. Gases suitable for use as a drying gas and/or a sweeping gas advantageously consist in such chemically inert gases (in particular nitrogen and argon), but can also be constituted by other gases in certain contexts, for example air when the context is drying waste based on zirconium, . . . .

Said gas for use as a drying gas and/or a sweeping gas is inert relative to the risk of pyrophoricity as it exists in any particular case.

SUMMARY OF THE INVENTION

In a first aspect, the invention thus provides a method of drying metallic waste that is likely to catch fire and/or explode, said dried waste being for compacting. In characteristic manner, said method comprises:

loading said waste into a compacting canister; said canister of cylindrical or prismatic shape having one or more axial walls, a bottom, and a cover, and being fitted with means respectively for enabling a drying inert gas (G) to be introduced and evacuated so as to dry said waste loaded in said canister, said means for introducing and evacuating said drying inert gas (G) being arranged relative to each other in such a manner that said drying inert gas (G) introduced into the canister flows significantly through said waste prior to being evacuated from the canister, said canister being closed by its cover after being loaded (the compacting canister is thus fitted with means for drying the waste within the canister (see the last step of the presently described method), which drying takes place prior to performing compacting);

said canister, prior to said loading, having previously been positioned empty in the cavity of a moving enclosure, said cavity being formed in the body of said moving enclosure and being open on top (first variant implementation of this loading first step), or otherwise said loaded canister closed by its cover is positioned in the cavity of a moving enclosure, said cavity being provided in the body of said moving enclosure and being open on top (second variant implementation of this loading first step; this second variant is preferred in which the already-loaded canister is positioned, once full, in the suitable receiving cavity of a moving enclosure); then:

docking said moving enclosure loaded with said canister itself loaded with said waste to a stationary docking station (in characteristic manner, this docking station constitutes a stationary docking head); said stationary docking station presenting a configuration adapted to confine said canister in a hermetically closed volume once said moving enclosure has docked; and being fitted with means respectively for delivering said drying gas (G) into said canister and for evacuating said drying gas (G) from said canister; said means of said docking station being suitable respectively for co-operating with the means for introducing and evacuating said gas (G) that are fitted to said canister, either directly or via means for circulating said gas (G) formed in the body of said moving enclosure (the various means in question constitute a circuit for delivering and removing said drying inert gas (G)); and setting said drying inert gas (G) into circulation through said canister confined in said docked moving enclosure.

It is mentioned above that said canister is closed by its cover. It is generally closed in this way in non-sealed manner (where the term "sealed" is employed with the strict meaning which is given to it in the nuclear context). Said cover closes the canister, generally in non-sealed manner, because of the subsequent compacting of said canister. Said cover is generally merely clipped on.

In characteristic manner, the drying operation is implemented on the waste as already packaged in the compacting canister. The drying operation is implemented by causing drying inert gas to flow through said waste, i.e. within said compacting canister while it is placed in a moving enclosure, itself docked to a stationary docking station. Said drying operation is thus implemented with said waste being confined in the cavity of the moving enclosure, whose open top portion has been hermetically closed by the docking.

The drying gas (G) is an inert gas so as to avoid any reaction of the gas on coming into contact with pyrophoric waste. It is used at a temperature which is suitable for performing its drying gas function. Said drying gas is generally caused to flow so that a significant flow occurs through the compacting canister in a downward or an upward direction. It is possible to devise other implementations for delivering and recovering said gas at the docking station, for introducing it into the compacting canister, and for evacuating it from said canister (a priori, in the light of the above remarks, respectively at the top and bottom or at the bottom and top portions thereof).

In preferred manner, for said introduction and evacuation of said drying gas, suitable means are implemented on the compacting canister independently, and more preferably in combination, said means being located firstly on the bottom of the compacting canister and secondly on the cover of said compacting canister.

In a first implementation, for introduction or evacuation, and advantageously for introduction of the drying inert gas (G), the appropriate means of the docking station co-operate with the suitable means fitted to the bottom of said canister via means for allowing said gas (G) to flow and provided in the body of said moving enclosure.

In this first implementation:

either said drying gas delivered to the docking station travels firstly into the canister through the waste, is evacuated through the bottom of said canister, and then travels through the body of the moving enclosure prior to being evacuated via said docking station;

or else said drying gas delivered to the docking station moves through the body of the moving enclosure, penetrates into the canister via its bottom, travels inside said canister through the waste, and is evacuated from the top at said docking station.

The second variant specified above is preferred. It is advantageously implemented with a check valve fitted to the bottom of the compacting canister. It would not be impossible to have such an injection check valve for the introduction of the drying gas (G) differently fitted.

In a second implementation, that can be considered independently but is preferably considered in combination with the first implementation explained above, for introduction or for evacuation, and advantageously for evacuation, of said drying inert gas (G), the appropriate means of the docking station co-operate directly with the appropriate means fitted to the cover of said canister.

In the context of the second implementation, introduction or evacuation takes place directly (without flowing through the body of the moving enclosure) via the cover of the compacting canister.

Advantageously the drying inert gas is evacuated in this way directly via said cover.

In general, it is preferable to implement evacuation of the drying inert gas under conditions which limit the entrainment of dust. Thus, in the context of the advantageous variant specified above, the gas evacuation means arranged on the cover of the compacting canister are advantageously arranged to limit the entrainment of dust.

Advantageously, in order to implement the method of the invention, the two preferred implementations explained above are combined in the following manner:

the drying gas delivered to the docking station travels through the body of the moving enclosure and penetrates into the canister via its bottom; and said drying gas is evacuated from said canister via its cover.

Methods of implementing drying gas flow are specified above in non-limiting manner.

It will already have been understood that once drying has terminated, the feed of drying gas is stopped. The moving enclosure is then undocked. The compacting canister loaded with dry waste can then be recovered in order to perform compacting.

Drying implemented as described above by causing a drying inert gas to flow through the waste packaged in the compacting canister itself confined in a hermetically closed volume obtained by docking the moving enclosure loaded with said canister to a stationary docking station, advantageously further includes sweeping a fraction of said hermetically closed volume that is not occupied by said canister with an inert gas (G') delivered by appropriate means from said stationary docking station either directly or via means provided in the body of said moving enclosure for conveying a stream of said inert gas (G'), and the sweeping gas (G') is evacuated together with said drying inert gas (G) by the means for evacuating said docking station via means arranged in the body of said moving enclosure for establishing a flow of said inert gas (G'), or else directly.

The involvement of this sweeping inert gas (G') (identical or different, advantageously identical in nature with the drying inert gas (G)) is advantageous for establishing counter-pressure and thus avoiding any leakage of the drying inert gas (G) (possibly carrying dust) into the fraction of the hermetically closed volume that is then not occupied by the canister, i.e. in the cavities of the docked moving enclosure. Said sweeping inert gas (G') is advantageously used hot, so that heat losses from the canister to the enclosure are limited.

In a particularly preferred variant implementation, the drying method of the invention includes causing the drying inert gas (G) and the sweeping inert gas (G'), when such a sweeping gas is used, to flow via means of the fixed pipework type. This type of pipework wears more slowly and thus needs to be replaced less often than flexible pipework. This type of pipework is thus logically preferred in a context of handling pyrophoric waste, particularly in a context of handling pyrophoric waste in the nuclear industry.

The method of the invention as described above in general terms and in more precise terms with reference to advantageous variants, advantageously comprises using of its advantageous variants in combination, i.e., in a preferred implementation, it comprises:

loading the waste into a compacting canister; said canister presenting on its bottom a check valve suitable for introducing the drying inert gas (G), and on its cover means suitable for evacuating said drying inert gas (G) while limiting the entrainment of dust;

positioning said loaded canister closed by its cover (generally in non-sealed manner (see above)), in the cavity of a moving enclosure; said cavity being provided in the body of said moving enclosure and opening out in the top portion thereof;

docking said moving enclosure loaded with said canister, itself loaded with said waste, to a stationary docking station, said stationary docking station:

presenting a suitable configuration for said canister to be confined in a hermetically closed volume once said moving enclosure has docked; and being fitted with fixed pipework respectively for delivering into said canister and for evacuating from said canister said drying inert gas (G); said fixed pipework for delivering said drying inert gas (G) co-operating with said check valve provided on the bottom of said canister via fixed pipework for circulating said drying inert gas (G) and provided in the body of said moving enclosure, and said fixed pipework for evacuating said drying inert gas (G) co-operating directly with the means for evacuating said inert gas (G) provided on the cover of said gas;

setting said drying inert gas (G) into circulation through said canister confined in said docked moving enclosure together with setting the sweeping inert gas (G') as delivered by fixed pipework of said docking head into circulation via fixed pipework for circulating said sweeping inert gas (G') and provided in the body of said moving enclosure, through the fraction of the hermetically closed volume that is not occupied by said canister, said sweeping inert gas (G') being evacuated directly together with said drying inert gas (G) via the fixed evacuation pipework of said docking head.

Whatever the implementation of the method of the invention, and most particularly in the context of the above preferred implementation, it is advantageous to limit loss of heat conveyed by the drying inert gas (G). For this purpose, the moving enclosure in which the waste-loaded canister is positioned is itself thermally insulated (advantageously covered in suitable lagging) and/or the sweeping inert gas (G') used is advantageously delivered hot.

Concerning the metal waste processed, i.e. dried, in accordance with the invention, it is mentioned above that it can be constituted in particular by radioactive waste, more particularly shells and endpieces that result from shearing irradiated nuclear fuel assemblies. Said waste contains in particular zirconium and/or magnesium and/or alloys of these metals.

In general, the drying and sweeping inert gases (G, G') are selected from nitrogen ($N_2$) and argon (Ar), given the pyrophoricity of the waste in question.

The drying inert gas is delivered at a temperature that is determined in application of the following criteria:

the temperature is as high as possible in order to limit drying time as a function of the degree of wetness of the waste in question;

the temperature is nevertheless below the melting temperature of the materials constituting and/or covering the canister and the cavity;

the temperature is naturally limited because of the risk presented by the pyrophoricity of said waste.

Thus, said drying inert gas is generally delivered at a temperature lying in the range 180° C. to 210° C.

As mentioned above, the sweeping gas is advantageously used hot so as to limit heat losses. Its temperature is therefore advantageously sufficiently high to limit such heat losses, but in any event it remains limited so as to be below the melting temperature of the materials constituting and/or covering the canister and the cavity.

Said sweeping gas is thus advantageously delivered at a temperature lying in the range 80° C. to 120° C.

Under such temperature conditions, and with waste based on zirconium, it is also possible to envisage using air as the drying and/or sweeping gas.

The method of the invention has been used in particular for drying shells and endpieces in less than half an hour by delivering:

the drying gas (nitrogen) at a rate of 140 standardized cubic meters per hour ($Nm^3/h$) at a temperature of 200° C.; and the sweeping gas (nitrogen) at a rate of 19 $Nm^3/h$ at a temperature of 100° C. (while keeping the apparatus at a maximum relative pressure of 2 bars).

In a second aspect, the invention provides an apparatus for drying metallic waste that is liable to catch fire and/or explode, the apparatus being particularly useful in implementing the above-described drying method. Said apparatus comprises:

a canister for compacting said waste, the canister being cylindrical or prismatic in shape, presenting one or more axial walls, a bottom, and a cover suitable for closing it (generally in non-sealed manner (see above)), said canister being fitted with means respectively for enabling a gas to be introduced and evacuated in order to dry waste loaded into said canister; said gas introduction and evacuation means being arranged relative to each other in such a manner that said introduced gas flows significantly through the inside of said canister prior to being evacuated;

a moving enclosure presenting a cavity formed in its body and opening out in its top portion; said cavity being suitable for receiving said canister; and a stationary docking station for docking to said moving enclosure loaded with said canister; said stationary docking station:

presenting a configuration that is suitable for said canister to be confined in a hermetically closed volume after said moving enclosure has docked; and being fitted means respectively for delivering a drying gas (G) into said canister and for evacuating said drying gas (G) from said canister; said means of said docking station being respectively suitable for co-operating with the means for introducing and for evacuating said gas (G) fitted to said canister, either directly or via means for circulating said gas (G) and provided in the body of said moving enclosure.

It can be considered that said compacting canister constitutes the key element of the drying apparatus of the invention.

Said canister is a canister of the same type as is used in the prior art and it is fitted with means to enable a significant stream of drying gas to flow through it, i.e. means that are significantly far apart from one another, respectively for introducing and for evacuating said gas.

Said means for introducing and evacuating the drying gas, as mentioned above in the present specification with reference to describing the drying method, are generally arranged, one at the bottom and the other at the top of the canister.

It is equally possible for at least one of them or both of them to be arranged in the axial wall(s) of the canister. Nevertheless, it is preferable for said gas introduction and evacuation means to be arranged, one on the bottom of said canister and the other on the cover of said canister. This optimizes the volume of waste that comes into contact with the drying gas; said drying gas thus sweeps through a maximum volume of waste.

Said means for introducing and evacuating drying gas consist, independently of each other, in any means that are suitable for achieving the intended purpose, however they must not allow any significant leakage of dust.

For introducing the gas, a check valve is advantageously used (said check valve opens under the pressure of the injected gas; it is protected by a bell from any waste that might prevent it from operating properly); for evacuating the gas, at least one evacuation orifice is advantageously provided. The size of said orifice and its association with suitable means can be optimized to minimize the entrainment of dust.

In two preferred variant embodiments, that can be considered independently of each other and advantageously in combination:

- a gas introduction check valve is fitted to the bottom of the compacting canister; and
- a gas evacuation orifice is provided through the cover of the compacting canister and advantageously means arranged on the inside face of said cover in register with said orifice constitute an obstacle to dust being entrained.

Associated with said canister, the apparatus of the invention comprises at least one moving enclosure and the docking station for docking said moving enclosure while it contains said canister, as described above.

In an advantageous variant, said apparatus is also fitted with means for being swept with the inert gas (G'). More precisely, said stationary docking station is also fitted with means for delivering a gas (G') for sweeping that fraction of said hermetically closed volume that is not occupied by said canister after said moving enclosure has docked; said means delivering said gas (G') directly or via means for circulating said gas (G') and provided in the body of said moving enclosure, and said means for evacuating the drying gas (G) being suitable for evacuating said sweeping gas (G'), implemented via means for circulating said sweeping gas (G') provided in the body of said moving enclosure, or directly.

The means of said drying apparatus of the invention are advantageously arranged so as to implement the advantageous variants of the drying method of the invention. Thus:

- the compacting canister is advantageously as described above when describing the advantageous variant embodiments; and/or
- the means for delivering, evacuating, and optionally setting into motion said drying gas (G) and also optionally said sweeping gas (G') are advantageously of the fixed pipework type; and/or
- the moving enclosure is advantageously lagged.

In a final aspect, the invention relates to the most advantageous embodiment of the compacting canister. It provides a canister for compacting metallic waste that is liable to catch fire and/or explode, and in particular a canister that is suitable for use (very particularly suitable for use) in implementing the above-described drying method.

Said canister is cylindrical or prismatic in shape and presents one or more axial walls, a bottom wall, and a cover suitable for closing it (generally in non-sealed manner (see above)). It is also fitted:

- on its bottom with a gas introduction check valve; and
- in its cover with a gas evacuation orifice; means also advantageously being arranged on the inside face of said cover in register with said orifice to constitute an obstacle to entrainment of dust by said gas.

BRIEF DESCRIPTION OF THE DRAWINGS

The various aspects of the invention are described below with reference to the accompanying figures which show advantageous variants of said various aspects of the invention in non-limiting manner.

The figures are diagrams in which.

- said moving enclosure containing said compacting canister full of waste, ready for docking to the stationary docking station, suitable for delivering and evacuating the drying gas; and
- said moving enclosure loaded with said compacting canister containing said waste, docked to said stationary docking station while drying is taking place by a stream of drying inert gas flowing through the compacting canister.

MORE DETAILED DESCRIPTION

Figure 1:
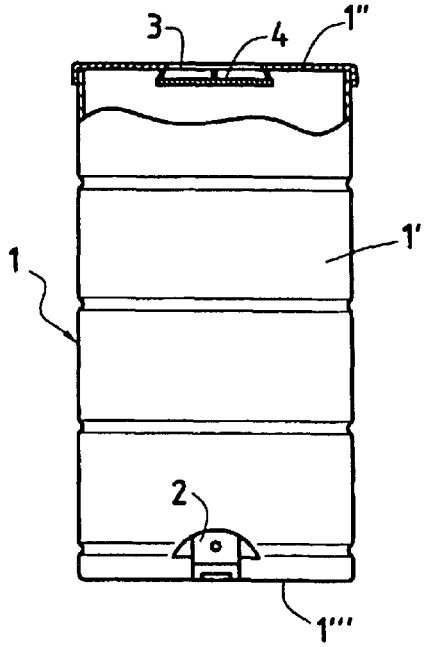
FIG. 1 shows a compacting canister of the invention, i.e. a canister fitted with means for drying the waste it is to enclose prior to implementing compacting.

The compacting canister 1 of FIG. 1 is a conventional canister in that it is cylindrical in shape and presents an axial wall 1', a cover 1", and a bottom 1'". Said cover 1" closes said canister 1 in non-sealed manner.

Said compacting canister 1 is a canister of the invention in that it is also fitted with means for introducing gas into its internal volume and for evacuating gas therefrom. The means in question are arranged respectively on its bottom 1'" and on its cover 1". For injecting the drying gas, a check valve 2 is provided on said bottom 1'". For evacuating said gas, an opening 3 is provided on said cover 1". Upstream from said opening 3 (secured to the inside face of the cover 1"), there is a plate 4. This plate serves to limit to a very great extent the amount of dust that is entrained by the drying gas flowing from the bottom of the canister towards the top. During the subsequent step of compacting the canister, this plate can also serve to shut said canister and thus prevent waste from escaping from said canister during said compacting. The check valve 2 is welded on the bottom 1'" of the canister 1. This check valve 2 is opened by the thrust from the gas flow that is injected.

Figure 2:
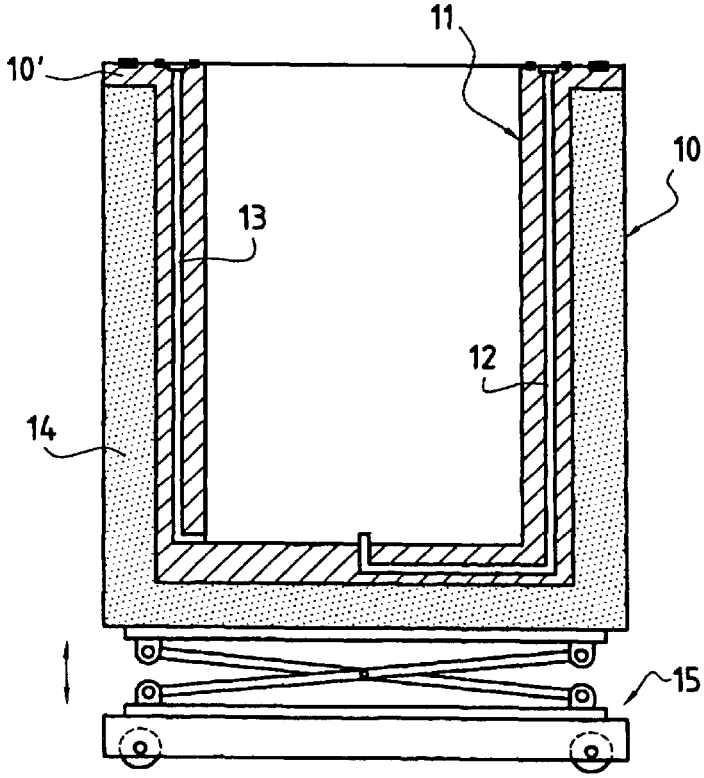
FIG. 2 shows a moving enclosure suitable for receiving said compacting canister, and for then docking to a suitable docking station for implementing drying.

The moving enclosure 10 shown diagrammatically in FIG. 2 is constituted by a body 10' presenting a cavity 11 having an open top suitable for receiving the canister 1 (previously optionally loaded with waste), and arranged on a base 15 having small wheels and elevator means. Said elevator means are operated to dock with the stationary docking station 20 (see FIGS. 3A and 3B).

Figure 3B:
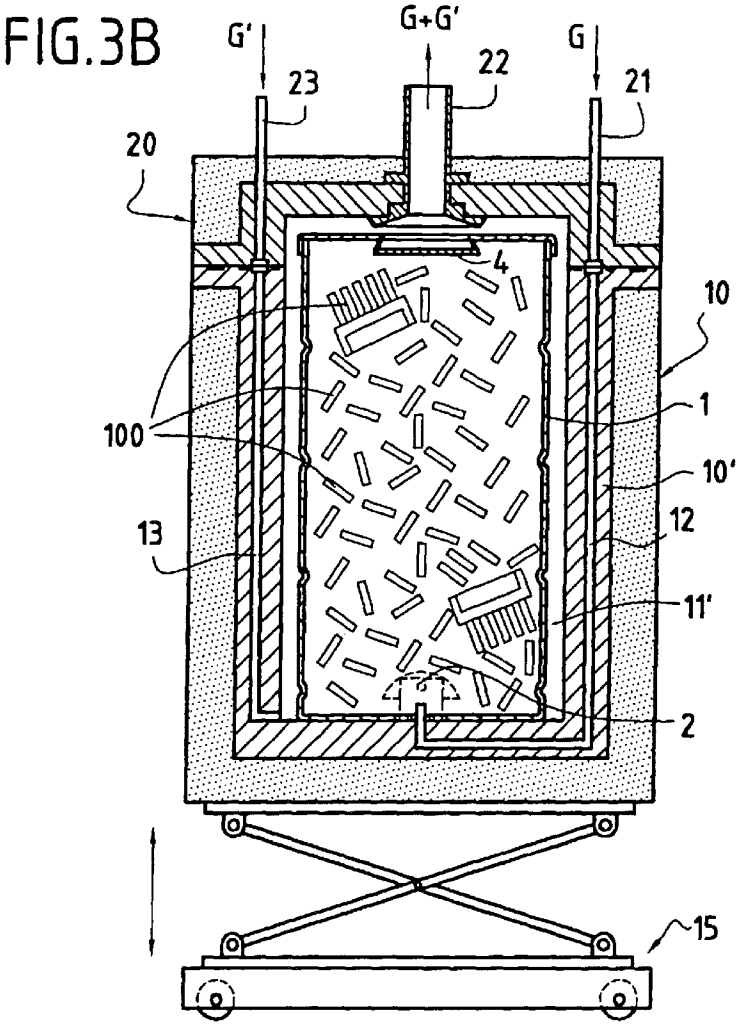
FIGS. 3A and 3B respectively show.

The body 10' of said moving enclosure 10 is fitted with a covering of lagging 14. It contains two pieces of fixed pipework:

pipework 12 which is used for circulating the drying gas (G) (see FIG. 3B); and pipework 13 which is used for circulating the sweeping gas (G') (see FIG. 3B).

Sealing gaskets are shown (but not referenced) on the top face of the body 10' of the moving enclosure 10. The gaskets are brought into play during docking. They contribute to establishing the hermetically closed volume 11' during said docking (see FIG. 3B).

Figure 3A:
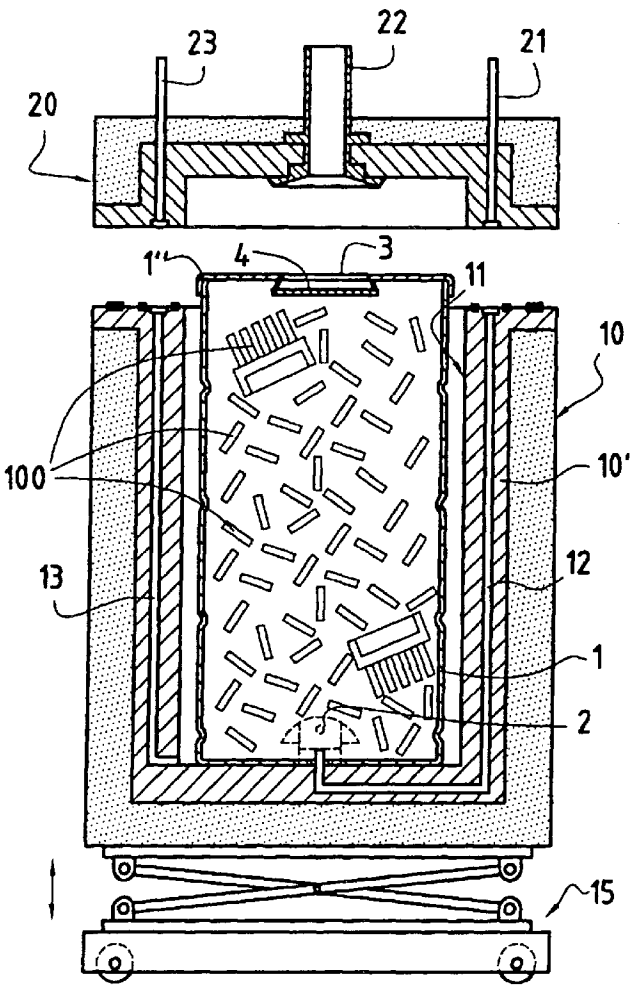

In FIGS. 3A and 3B, there can be seen said moving enclosure 10 loaded with the compacting canister 1, itself loaded with waste 100. Said waste 100 is of the shell and endpiece type that results from shearing irradiated nuclear fuel assemblies. It is recalled, incidentally, that the successive loading operations advantageously take place in the following order:

1) the canister 1 is loaded with waste 100; and 2) said loaded canister 1 is loaded (positioned) in the cavity 11 of the moving enclosure 10.

Said moving enclosure 10 loaded with the compacting canister 1 containing the waste 100 is brought up to the stationary docking station 20 in order to dry said waste 100. Said stationary docking station 20 is likewise lagged. It presents a configuration that is suitable for implementing docking. It is fitted with fixed pipework for respectively:

delivering the drying gas G: pipework 21;

delivering the sweeping gas G': pipework 23; and evacuating said drying and sweeping gases G and G': pipework 22.

Once docking has been accomplished (under drive from the elevator means of the moving enclosure 10), said drying and sweeping gases G and G' are set into circulation (injected respectively by the pipework 21 and 23).

The pipework 21 for delivering the drying gas G co-operates with the check valve 2 fitted to the bottom 1''' of the canister 1 via the pipework 12 that is provided in the body 10' of the moving enclosure 10. The injected gas G passes through the entire volume of the canister 1 in an upward direction and it is evacuated from said canister 1 directly through the opening 3. It is taken up together with the sweeping gas G' by the pipework 22. Extraction is implemented by means of a fan.

In characteristic manner, the drying of the invention is implemented in the compacting canister (final canister) while it is positioned in a moving enclosure 10 (inside a hermetically closed volume 11'), which is docked to a stationary docking station 20. The pipework involved is all constituted by fixed pipework (in an advantageous variant).

What is claimed is:

1. A method of drying metallic waste likely to catch fire and/or explode, said dried waste being for compacting, the method comprising:

loading said waste into a compacting canister; said canister of cylindrical or prismatic shape having one or more axial walls, a bottom, and a cover, and being fitted with means respectively for enabling a drying inert gas to be introduced and evacuated so as to dry said waste loaded in said canister, said means for introducing and evacuating said drying inert gas being arranged relative to each other in such a manner that said drying inert gas introduced into the canister flows significantly through said waste prior to being evacuated from the canister, said canister being closed by its cover after being loaded; said canister, prior to said loading, having previously been positioned empty in the cavity of a moving enclosure, said cavity being formed in the body of said moving enclosure and being open on top, or otherwise said loaded canister closed by its cover is positioned in the cavity of a moving enclosure, said cavity being provided in the body of said moving enclosure and being open on top; then:

docking said moving enclosure loaded with said canister itself loaded with said waste to a stationary docking station; said stationary docking station presenting a configuration adapted to confine said canister in a hermetically closed volume once said moving enclosure has docked; and being fitted with means respectively for delivering said drying gas into said canister and for evacuating said drying gas from said canister; said means of said docking station being suitable respectively for co-operating with the means for introducing and evacuating said gas that are fitted to said canister, either directly or via means for circulating said gas formed in the body of said moving enclosure; and setting said drying inert gas into circulation through said canister confined in said docked moving enclosure.

2. The method according to claim 1, wherein, for introducing or evacuating, advantageously for introducing, said drying inert gas, the suitable means of the docking station co-operate with the suitable means fitted to the bottom of said canister via means for circulating said gas arranged in the body of said moving enclosure.

3. The method according to claim 2, wherein said drying inert gas is introduced into said canister via a check valve fitted to the bottom of said canister.

4. The method according to claim 1, wherein, for introducing or evacuating, advantageously evacuating, said drying inert gas, the suitable means of the docking station co-operate directly with the suitable means fitted to the cover of said canister.

5. The method according to claim 1, wherein said drying inert gas is evacuated under conditions which limit the entrainment of dust.

6. The method according to claim 1, wherein, in parallel with setting said drying inert gas into circulation, the method includes sweeping the fraction of the hermetically closed volume that is not occupied by said canister with an inert gas delivered by suitable means from said stationary docking station either directly or via means for circulating said inert gas and formed in the body of said moving enclosure, and evacuated together with said drying inert gas by the evacuation means of said docking station via means for setting said inert gas into circulation and arranged in the body of said moving enclosure, or else directly.

7. The method according to claim 6, wherein said sweeping inert gas is selected from nitrogen and argon, or even air, and is advantageously delivered hot, advantageously at a temperature lying in the range 80° C. to 120° C.

8. The method according to claim 1, wherein said drying inert gas and said sweeping inert gas when used, circulates in means of the fixed pipework type.

9. The method according to claim 1, comprising:

loading said waste into a compacting canister; said canister presenting on its bottom a check valve suitable for introducing the drying inert gas, and on its cover means suitable for evacuating said drying inert gas while limiting the entrainment of dust;

positioning said loaded canister closed by its cover in the cavity of a moving enclosure; said cavity being provided in the body of said moving enclosure and opening out in the top portion thereof;

docking said moving enclosure loaded with said canister, itself loaded with said waste, to a stationary docking station, said stationary docking station:

presenting a suitable configuration for said canister to be confined in a hermetically closed volume once said moving enclosure has docked; and being fitted with fixed pipework respectively for delivering into said canister and for evacuating from said canister said drying inert gas; said fixed pipework for delivering said drying inert gas co-operating with said check valve provided on the bottom of said canister via fixed pipework for circulating said drying inert gas and provided in the body of said moving enclosure, and said fixed pipework for evacuating said drying inert gas co-operating directly with the means for evacuating said inert gas provided on the cover of said gas;

setting said drying inert gas into circulation through said canister confined in said docked moving enclosure together with setting said sweeping inert gas as delivered by fixed pipework of said docking head into circulation via fixed pipework for circulating said sweeping inert gas and provided in the body of said moving enclosure, through the fraction of the hermetically closed volume that is not occupied by said canister, said sweeping inert gas being evacuated directly together with said drying inert gas via the fixed evacuation pipework of said docking head.

10. The method according to claim 1, the method being implemented with limitation of heat loss from said drying inert gas; said moving enclosure being thermally insulated and/or said sweeping inert gas, if used, advantageously being used hot.

11. The method according to claim 1, wherein said drying inert gas is selected from nitrogen and argon, or even air, and is delivered at a temperature lying in the range 180° C. to 210° C.

12. The method according to claim 1, wherein said metallic waste is radioactive waste, containing zirconium and/or magnesium and/or alloys of these metals, in particular.

* * * * *